US008684634B2

(12) United States Patent
Belich et al.

(10) Patent No.: US 8,684,634 B2
(45) Date of Patent: Apr. 1, 2014

(54) WORKER'S CAGE FOR EXCAVATION WORK

(75) Inventors: Mark M. Belich, Willoughby Hills, OH (US); Martin J. Belich, Fort Myers Beach, FL (US)

(73) Assignee: Great Lakes Crushing Ltd., Eastlake, OH (US)

( * ) Notice: Subject to any disclaimer, the term of this patent is extended or adjusted under 35 U.S.C. 154(b) by 0 days.

(21) Appl. No.: 13/355,924

(22) Filed: Jan. 23, 2012

(65) Prior Publication Data

US 2013/0022410 A1 Jan. 24, 2013

Related U.S. Application Data

(60) Provisional application No. 61/435,511, filed on Jan. 24, 2011.

(51) Int. Cl.
*E02D 17/08* (2006.01)

(52) U.S. Cl.
USPC ..... 405/282; 405/147

(58) Field of Classification Search
USPC ..... 405/282, 283, 157
See application file for complete search history.

(56) References Cited

U.S. PATENT DOCUMENTS

| | | | | |
|---|---|---|---|---|
| 3,922,866 | A * | 12/1975 | Benning | 405/283 |
| 4,202,649 | A * | 5/1980 | Cook et al. | 405/282 |
| 5,735,642 | A * | 4/1998 | Barringer | 405/282 |
| 6,422,805 | B1 | 7/2002 | Miller | |
| 7,402,003 | B2 * | 7/2008 | Kundel, Sr. | 405/283 |
| 7,766,582 | B2 * | 8/2010 | Worley | 405/282 |
| 2008/0247831 | A1 * | 10/2008 | Worley | 405/283 |

* cited by examiner

*Primary Examiner* — Frederick L Lagman
(74) *Attorney, Agent, or Firm* — Pearne & Gordon LLP

(57) ABSTRACT

Provided is a cage for protecting a worker in an excavation. The cage includes spaced apart side panels formed from a material suitably-strong to withstand a force exerted on the side panels by a collapsing wall of the excavation. A plurality of cross members extend between the side panels to substantially maintain a distance separating the side panels when subjected to the force exerted by the collapsing wall of the excavation. And a connection head that is cooperable with a coupler supported by a boom of a piece of mechanized equipment is included to couple the cage to the boom. The connection head is coupled to one or both of the side panels, one or more of the cross members, or one or both of the side panels and at least one of the cross members.

10 Claims, 6 Drawing Sheets

WORKER'S CAGE FOR EXCAVATION WORK

CROSS-REFERENCE TO RELATED APPLICATIONS

This application claims the benefit of U.S. Provisional Application No. 61/435,511, filed Jan. 24, 2011, which is incorporated in its entirety herein by reference.

BACKGROUND OF THE INVENTION

1. Field of the Invention

This application relates generally to an apparatus for protecting workers conducting excavation work and, more specifically, to a protective excavation cage that shields workers within a trench from debris entering the trench when a wall of the trench collapses.

2. Description of Related Art

Excavation work, particularly the excavation of trenches carried out by excavators, has traditionally been dangerous work. Digging machines such as excavators are commonly used to dig large holes in the ground to expose and/or install buried infrastructure such as sewers, water mains and residential lines, gas conduits and other pipelines, buried communication lines such as cables and fiber optic lines. Once the trench is excavated, a worker is often required to enter the hole to perform work along the bottom of the trench. With the worker concentrating on the work being performed at the bottom of the trench, any portion of the trench wall that caves in can possibly cover the worker, thereby trapping the worker in the trench.

To avoid these accidents, numerous laws have been passed requiring the sidewalls of such trenches to be tapered, or laid back outwardly at a specific angle to minimize the chance that the trench wall will collapse, possibly causing harm to the worker in the trench. Wall shoring devices have also been developed to retain the sidewalls of the trench while workers are working therein to prevent such cave-ins. These devices typically have rigid bracing members that bridge the trench to maintain a pre-determined space between the sidewalls of the device, defining a work area between the sidewalls. However, such devices are difficult to assemble, very cumbersome to handle and time consuming to install and remove. U.S. Pat. No. 3,922,866, the contents of which are incorporated herein by reference, shows a prior art worker's cage for excavation work.

BRIEF SUMMARY OF THE INVENTION

According to one aspect, the subject application involves a cage for protecting a worker in an excavation. The cage includes spaced apart side panels formed from a material suitably-strong to withstand a force exerted on the side panels by a collapsing wall of the excavation. A plurality of cross members extend between the side panels to substantially maintain a distance separating the side panels when subjected to the force exerted by the collapsing wall of the excavation. And a connection head that is cooperable with a coupler supported by a boom of a piece of mechanized equipment is included to couple the cage to the boom. The connection head is coupled to one or both of the side panels, one or more of the cross members, or one or both of the side panels and at least one of the cross members.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
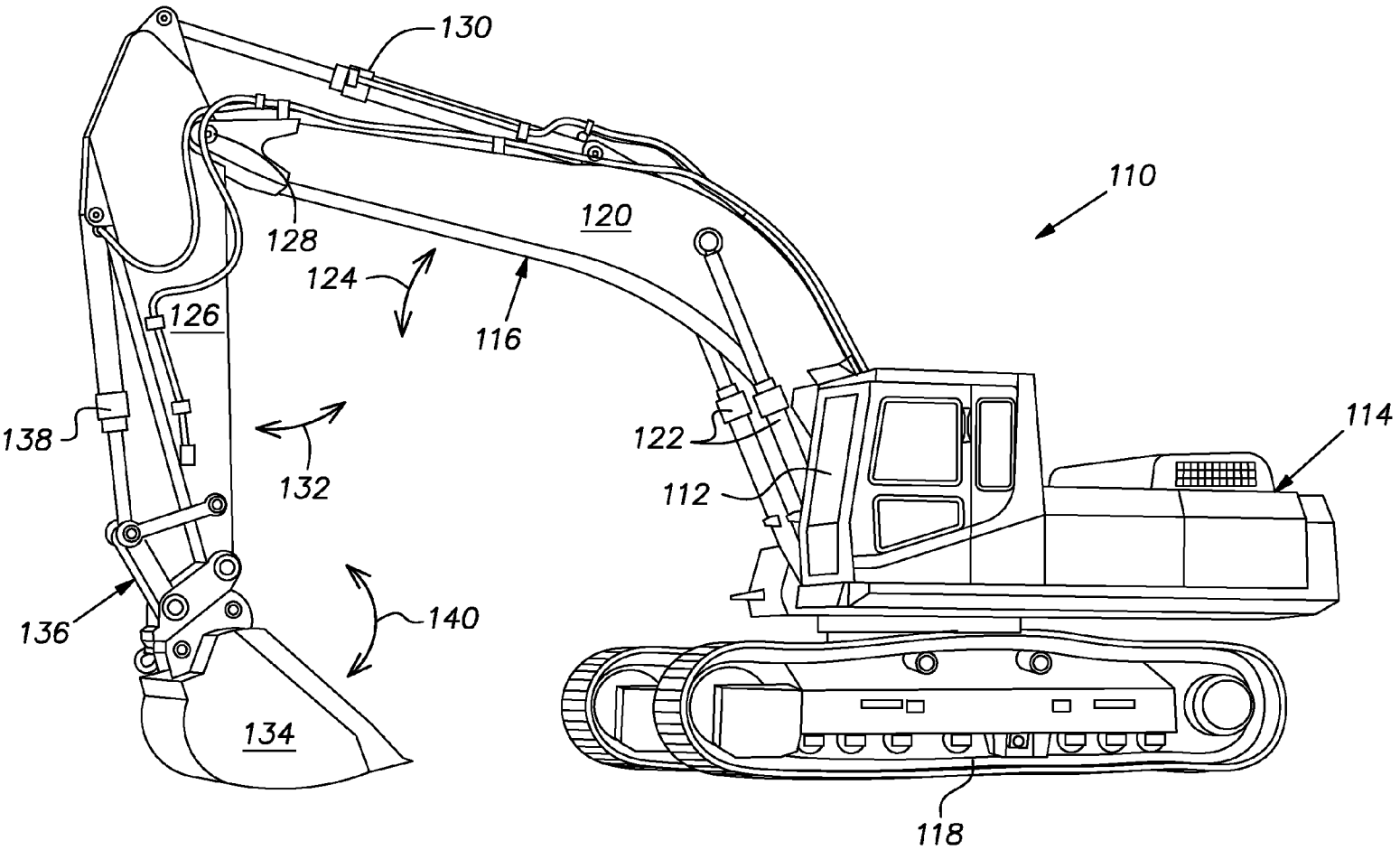
FIG. 1 shows a side view of a piece of mechanized equipment in the form of an excavator with a digging bucket.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

FIG. 1 shows an illustrative embodiment of a digging machine commonly used to excavate a trench. As shown, the embodiment of the digging machine is what is commonly referred to as an excavator 110, which includes a cab 112 where an operator sits to drive the excavator 110. An engine and counterweight portion 114 generates the driving forces that power the excavator 110 and act as a counterbalance to forces imparted on a boom 116. A pair of tracks 118 allows the excavator to travel over the ground to the location where a trench is to be excavated.

The boom 116 is an articulated member that is formed from a plurality of interconnected arm portions. For the embodiment shown in FIG. 1, a proximate arm 120 is pivotally coupled to the engine and counterweight portion 114 to be elevated and lowered along a path indicated by arrow 124 through the operation of hydraulic actuators 122 controlled by the operator. A distal arm 126 is pivotally coupled to the proximate arm 120 by a hinged connection 128. A hydraulic actuator 130 extends between the proximate arm 120 and an extension portion of the distal arm 126 to allow the operator to control fore and aft pivoting of the distal arm 126 about the hinged connection 128 in the directions indicated by arrow 132.

Adjacent to an end of the distal arm 126 opposite the hinged connection 128 is a digging bucket 134, which is replaceable with other attachments. Similar to the coupling between the proximate and distal arms 120, 126, the bucket 134 is pivotally coupled to the distal arm 126 by a hinged connection 136. Another hydraulic actuator 138 extends between the distal arm 126 and the hinged connection 136 to allow the operator to curl and uncurl the bucket 134 in the directions indicated by arrow 140. Although described and shown herein as a hydraulic excavator 110, the term "excavator" includes any mechanized machine that is operable to dig a hole in the ground, such as hydraulic excavators produced by Caterpillar® of Peoria, Ill., backhoes provided to a machine with front-loading capabilities, wheeled excavators, and the like.

Figure 2:
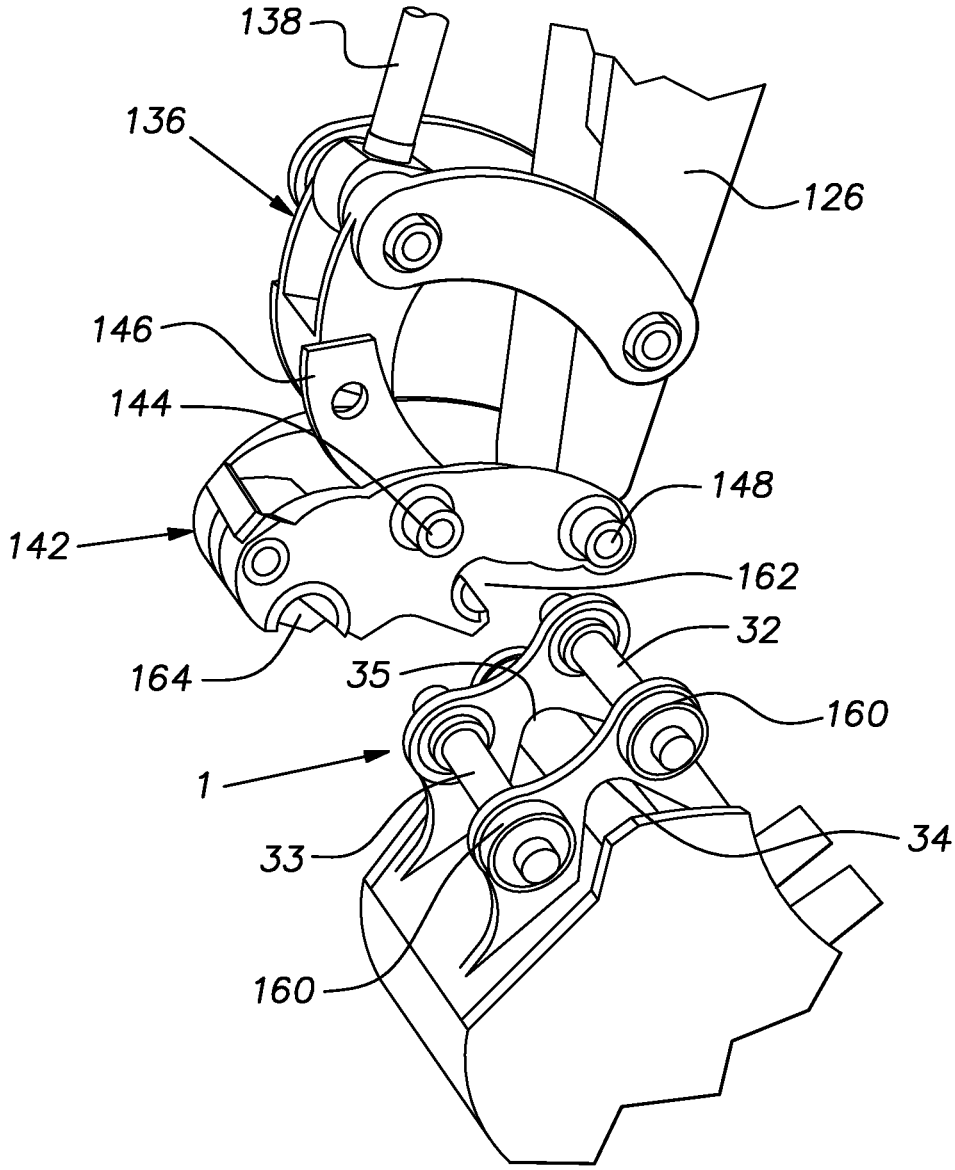
FIG. 2 shows an illustrative embodiment of a hinged connection that allows a bucket to be curled and uncurled, and a quick connect coupler supported adjacent to an end of the hinged connection.

FIG. 2 shows an illustrative embodiment of the hinged connection 136 allowing the bucket 134 to be curled and uncurled. For the illustrative embodiment shown, an example of a quick connect coupler 142 is also supported adjacent to an end of the hinged connection 136 to facilitate coupling and removal of an attachment provided with a mating coupling structure, referred to herein as a connection head 1, to and from the distal arm 126. Cooperation between the quick connect coupler 142 and the connection head 1 can optionally be established and terminated solely through operation of the hydraulic actuators provided to the excavator 110. In other words, for such embodiments an operator in the cab 112 can interact with the controls in the cab 112 that control operation of one or more of the hydraulic actuators provided to the excavator 110 to establish a secure connection between the quick connect coupler 142 and the connection head 1. This can optionally be accomplished without requiring the user to exit the cab 112, or otherwise without requiring manual intervention by any personnel from a time when establishing the connection between the quick connect coupler 142 and the connection head 1 begins until a time when the connection is established, to couple the attachment to the distal arm 126. Accordingly, the operator of the excavator 110 can optionally detach a first attachment with the connection head 1 from the excavator 110 and attach a second attachment comprising the connection head 1 to the excavator all from within the cab 112.

According to the embodiment shown in FIG. 2, the quick connect coupler 142 is pivotally coupled by a pin 144 to a brace 146 that is operatively coupled to be adjusted during operation of the hydraulic actuator 138. The quick connect coupler 142 is also pivotally coupled by another pin 148 to the distal arm 126 to pivot about the pin 148 in response to operation of the hydraulic actuator 138. When the hydraulic actuator 138 is extended, for example, the force from the hydraulic actuator 138 is transmitted by the brace 146 to the pin 144 of the quick connect coupler 142, thereby causing the quick connect coupler 142 to pivot in a counterclockwise direction about the pin 148 (from the frame of reference shown in FIG. 2). Contracting the hydraulic actuator 138 causes an opposite reaction, thereby causing the quick connect coupler 142 to pivot in the clockwise direction about the pin 148.

The embodiment of the connection head 1 shown in FIG. 2 includes first and second sidewalls 34, 35 laterally spaced apart from each other. Each sidewall can be welded, bolted, or otherwise securely fastened to an attachment to withstand the forces imparted therein when the attachment is lifted. A plurality (two in the present embodiment) of pins 32, 33 are inserted through respective pairs of apertures 28, 30 (FIG. 3) and 29, 31 (FIG. 3) formed in the sidewalls 34, 35 to extend entirely across the space between the sidewalls 34, 35, and optionally beyond the sidewalls 34, 35, where removable embodiments of the pins 32, 33 can receive safety pins 160 that prevent passage of the ends of the pins 32, 33 through the apertures 28-31. Such pins 32, 33 are said to be removeable in that they can be repeatedly removed, and optionally replaced by other pins without substantially damaging the sidewalls 34, 35.

In use, the quick connect coupler 142 is brought to within close proximity of the pins 32, 33 provided to the attachment to be coupled to the boom 116 and picked up by the excavator 110. A forward notch 162 or other suitable receiver provided to the quick connect coupler 142 can be positioned by the operator controlling the hydraulic actuators from within the cab 112 to extend at least partially about a forward pin 32. The operator can then control the hydraulic actuator 138 to perform an operation that would curl the attachment in the counterclockwise direction of arrow 140 shown in FIG. 1. As a result, a rearward notch 164 is positioned to receive, and extend at least partially about the rearward pin 33, thereby coupling the attachment provided with the connection head 1 to the end of the boom 116, where it can be lifted by the excavator 110 and transported to a desired destination. An embodiment of the quick connect coupler 142 can optionally include a latch (not shown) that can be adjusted by operation of a hydraulic actuator provided to the excavator 110, can be adjusted by its own dedicated hydraulic actuator, or even manually lockable to interfere with inadvertent removal of the connection head 1 from the quick connect coupler 142.

The embodiment shown in FIG. 2 and described herein to clearly illustrate the present technology includes a quick connect coupler 142 supported on the distal arm 126 of the excavator 110, and a pair of space pins 32, 33 provided on the attachment to be received by notches 162, 164 provided to a quick connect coupler 142. However, it is to be understood that the present technology is not limited to such an embodiment. There are different designs of connection heads provided to attachments compatible with excavators 110, and each design or configuration of such connection heads can be compatible with a different coupler provided to the end of the distal arm 126. For example, alternate embodiments can include one or a plurality of pins provided adjacent to the end of the distal arm 126 of the excavator, and one or a plurality of notches provided to a connection head of an attachment. Yet other embodiments may lack the pins and notches system described herein altogether but, instead, include a pair of mating surfaces that cooperate to securely couple the connection head to the distal arm 126 of the excavator's boom 116 where other attachments such as the digging bucket 134 are to be connected. Such compatibly-mating systems can optionally be "quick connecting" systems, allowing the operator to connect to (i.e., a working, operable connection where the attachment is ready for use), and release from various different attachments without exiting the cab 112. However, the embodiment of the connection head 1 compatible with the quick connect coupler 142 shown in FIG. 2 will be described herein for the sake of brevity.

Figure 3:
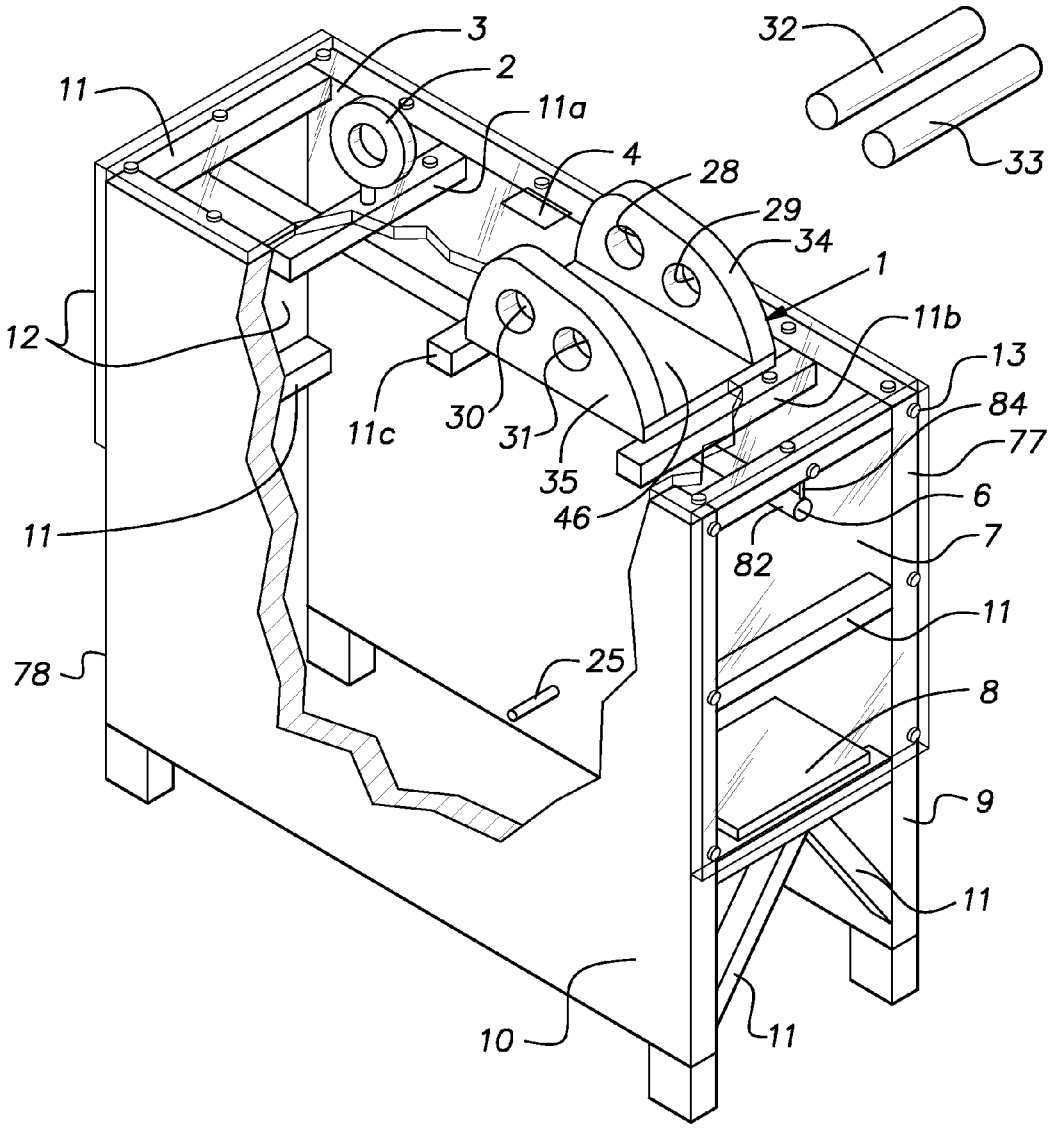
FIG. 3 is a perspective view of an illustrative embodiment of a worker's cage provided with a connection head for coupling the worker's cage to a coupler provided to a piece of mechanized equipment.

FIG. 3, shows a perspective view of cage 51 provided with the connection head 1 along a top portion of the cage 51 such that the connection head 1 is accessible from above when the cage 51 is in use. The connection head 1 is compatible with the quick connect coupler 142 shown in FIG. 2, allowing the operator to operably connect the cage 51 to the quick connect coupler 142 from within the cab 112, without exiting the cab 12 during the attachment process.

Figure 4:
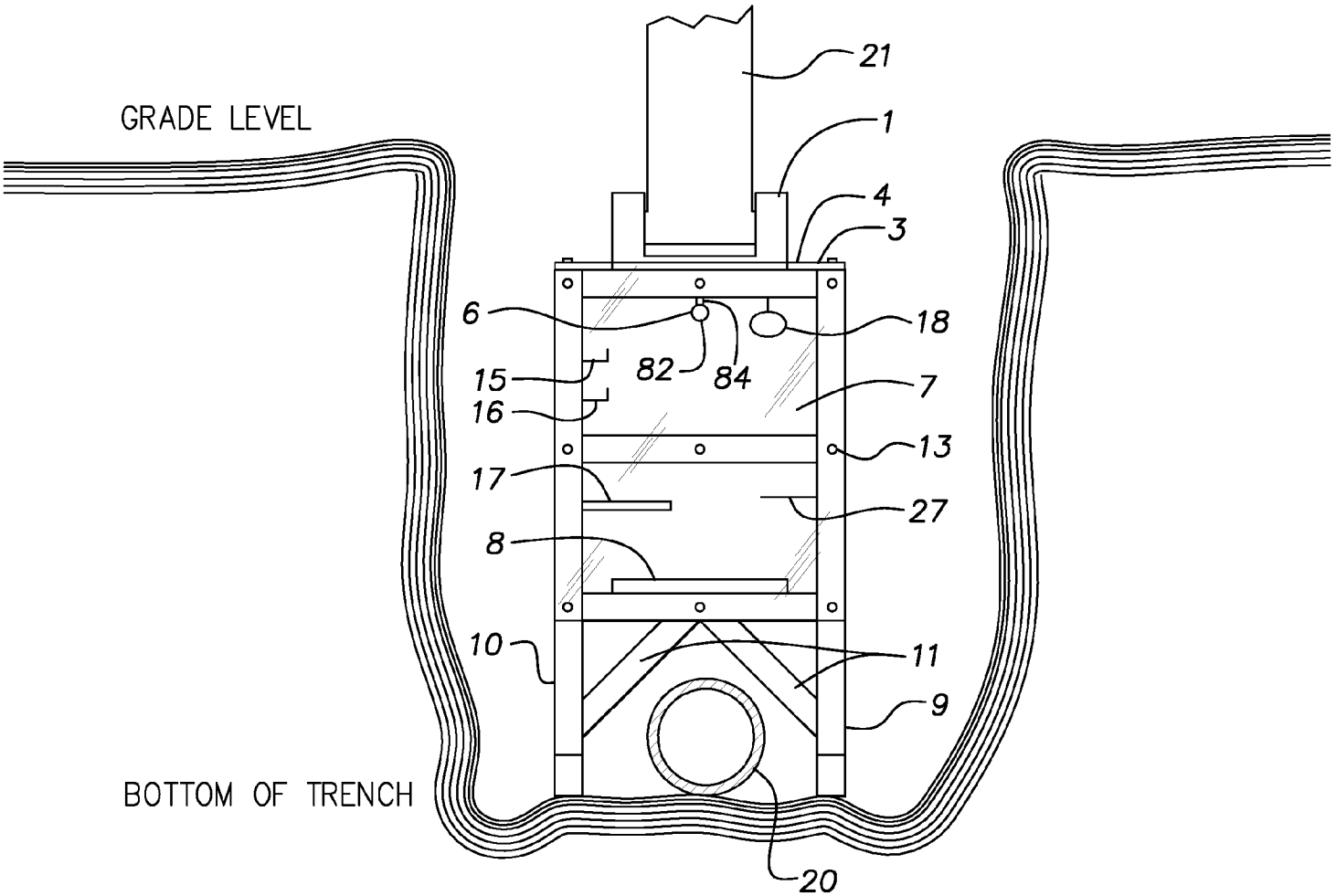
FIG. 4 is an end view of a worker's cage in a trench provided with a connection head for coupling the worker's cage to a coupler provided to a piece of mechanized equipment.

The cage 51 in FIG. 3 includes laterally-spaced side panels 9, 10 separated from each other by transversely-extending cross members 11. The side panels 9, 10 can be formed from steel or any other suitably-strong material such as other metals and metal alloys, for example, that can withstand the forces imparted thereon by debris falling into a trench when a trench wall collapses into the trench without being punctured. Accordingly, the side panels 9, 10 form protective barriers separating workers from collapsing side walls of the trench in which the cage 51 is placed. The side panels 9, 10 can optionally be substantially parallel to each other, and laterally spaced apart from each other a suitable distance to allow a worker to walk there between. For example, the distance between the sidewalls can be at least one (1 ft.) foot, and optionally at least one and a half (1.5 ft.) feet. According to other embodiments, the distance between the side panels 9, 10 can be at least two (2 ft.), up to about four (4 ft.) feet. Of course the side panels 9, 10 can be separate by any desired distance to fit within a specific trench as shown in FIG. 4, for example.

The side walls 9, 10 can be welded, bolted, rivoted or otherwise coupled to structural elements such as the cross members 11, for example, that maintain separation of the side walls 9, 10 from each other when subjected to a compressive force. For the illustrated embodiment, a cross member 11 extends transversely to a longitudinal axis of the cage 51 adjacent to the top portion of the cage 51, adjacent to a lower portion of the cage 51, and at an vertically-intermediate region between the top and bottom portions of the cage 51, adjacent to both longitudinally-spaced ends of the cage 51. Additionally, inward cross members 11*a*, 11*b*, 11*c* can also optionally be placed adjacent to the top and/or bottom portions of the cage 51 at locations along the longitudinal axis between the longitudinal ends of the cage 51 to provide added support to the central regions of the side walls 9, 10. Further, these intermediate cross members, such as cross member 11*a*, can serve as the structural support for a connector, shown in FIG. 3 as a lifting eye 2, that can support the weight of the cage 51, thereby allowing the cage 51 to be lifted by the lifting eye 2. The lifting eye 2 can include a an attachment point on the cage 51 where a hook attached to a chain, for example, can be clipped to couple the cage 51 to the boom 116. Lifting the cage 51 with the chain attached to the lifting eye 2 allows the cage 51 to spin freely around the chain for orientation to be placed in a trench. Similarly, cross members 11*b* and 11*c* are the structural elements to which the connection head 1 is coupled by welding, rivots, bolts, ect . . . .

The connection head 1 provided to the cage 51 in FIG. 3 includes the first sidewall 34 and the second sidewall 35 mounted to a base plate 46, which is itself mounted, optionally in a removable manner, to the structural elements of the cage 51. Alternatively, sidewalls 34, 35 can be mounted directly to the structural elements of the cage. As shown, the connection head 1 is adapted to be attached to the quick connect coupler 142 at the end of the boom 116 of the excavator 110. At least a portion of the connection head 1, such as the pins 32, 32 for example, is preferably removable from the cage 51 and replaceable and interchangeable to establish differently-sized and differently-configured connection heads 1 so that the cage 51 can be attached to different makes, models and/or sizes of couplers 142 provided to the excavator 110. In other words, since different excavator booms 116 may have differently-configured couplers, different connection heads 1 as known in the art may be put on the cage 51 so the cage 51 can be used with the different couplers, and thereby attached to a variety of different excavators 110.

Examples of different couplers and/or quick couplers suitable for connecting the cage 51 to the boom 116 of the excavator 110 include, but are not limited to: Wedgelock Quick Coupler from Leading Edge Attachments, Inc., of Jefferson Mass.; the Gorilla Quick Couplers from Tech Hydraulics, Inc., of Randolph, Mass.; Lemac Pin-Grip Quick-Coupler, from Lemac Corporation, of Petersburg, Va.; Klac Coupler System from Rockland Manufacturing Company; VersaLoc Quick Coupler from Paladin Heavy Construction, of Akron Ohio; each of which are incorporated herein by reference. These and other couplers and quick couplers known in the art can be used to attach the cage to the end of the boom or arm or stick of the excavator. As mentioned above, the connection head 1, or at least a portion thereof, is preferably removably attached to the cage 51 so different connection heads can be interchangeably attached to the cage 51 to accommodate different sizes and brands of couplers on the excavator 110.

As shown in the drawings, the connection head 1 is attached off center (i.e., closer to a first end along a longitudinal axis extending lengthwise along the cage 51) spaced apart along the longitudinal axis from the lifting eye 2, which itself can be located adjacent to a central location or adjacent an end opposite the end adjacent to the connection head 1 along a top portion of the cage 51. Alternatively, the connection head 1 can be attached to the cage 51 at a location approximately in the center of the top portion, or anywhere accessible at the top portion, or the locations of the lifting eye 2 and connection head 1 can be reversed. Alternatively, the connection head 1 can be mounted on a he back wall or an end wall 77 (FIG. 3) where a transparent panel 7 is mounted, or on along an opposite end wall 78 where panel 12 is mounted.

Figure 7:
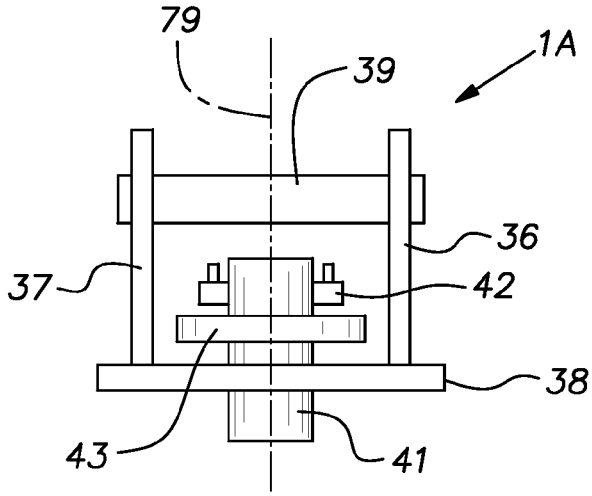
FIG. 7 shows an end view of the pivotal connection shown in FIG. 6, from the point of view indicated by line 7-7.
Figure 6:
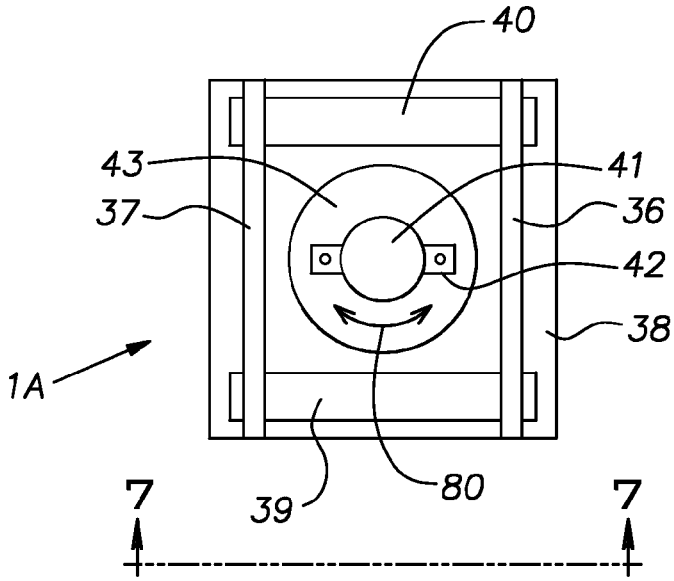
FIG. 6 shows a top view of a pivotal connection that pivotally couples a worker's cage to a boom of a piece of mechanized equipment, establishing a range of travel that the cage can be pivoted relative to a coupler provided to the boom.
Figures 8, 9:
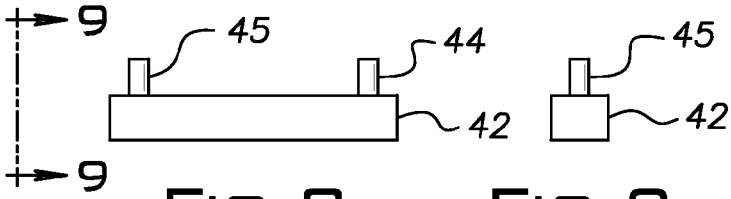
FIG. 8 is an isolated view of a locking bar that interferes with removal of a metal pin through an aperture formed in a bracket.
FIG. 9 shows an end view of the locking bar shown in FIG. 8, from the point of view indicated by line 9-9.

In the preceding discussion the connection head 1 has been solidly mounted (e.g., welded, or otherwise attached at a fixed location to the cage 51). For such embodiments, the orientation of the cage 51 to which the connection head 1 was mounted could not be adjusted relative to the connection head 1. Alternate embodiments, however, include a connection head 1A (FIGS. 6 and 7) mounted to the cage 51 so that the cage 51 can swivel or rotate with respect to the connection head 1, around a vertical axis 79 extending upward through a center of the connection head 1A. As shown in FIGS. 6 and 7, such a connection head 1A includes a base plate 38, also referred to as a bracket 38 since the base plate 38 is not necessarily planar or plate shaped, corresponding to base plate 46 in FIG. 3. The base plate 38, however, is not securely and fixedly mounted to the cage 51 as the base plate 46 discussed above can be. Mounted on plate 46 are a first sidewall 36 and second sidewall 37 that extend upwardly from the base plate 38. Any suitable connector compatible with the coupler provided to the boom 116 can be utilized, such as pins 39, 40 in FIG. 6, which correspond to pins 33, 32 in FIGS. 2 and 3. The pins 39, 40 are mounted to extend between, and optionally through the sidewalls 36, 37 as shown. A steel or metal cylinder or pin 41 is mounted or attached to the cage 51, preferably without intending to make it removeable, i.e., by welding for example. Plate 38 defines an aperture through which the pin 41 extends through the plate 38, and the plate 38 can optionally be positioned such that the aperture is slid down onto the pin 41. Then a disk-shaped annular washer 43 also defining an aperture can be slid down onto the pin 41 to act as a flange. The flange is located vertically above the plate 38 and has an external dimension (e.g., diameter) larger than an internal diameter (e.g., diameter) of the aperture to interfere with removal of the pin 41 through the aperture in the plate 38. Although described as a washer 43, the flange can be any suitable protrusion that prevents the pin 41 from being pulled fully downwardly through the aperture. Then, a locking bar or pin 42 can be inserted to extend entirely through an interior, cylindrical passage formed in the pin 41 that extends transversely to the vertical axis 79 and is open at opposing sides of the pin 41. Locking bar 42 is then locked in place by screwing in set screws 44, 45 or cotter pins or the like so they protrude beyond the periphery of the locking bar 42 a short distance to interfere with removal of the locking bar 42 when in place. Then when the coupler such as the quick connect coupler 142 on the excavator boom 116 attaches to pins 39, 40 and lifts the cage 51 as described above, the cage 51, and the pin 41 attached to the cage 51, can be pivoted or swiveled angularly about the vertical axis 79 in the directions indicated by arrow 80 in FIG. 6.

According to another embodiment, the locking bar 42 can optionally be nested in a shallow groove in the top of washer 43 so they are interlocked. Regardless of the particular arrangement, the connection head 1A provided to the cage 51 can cooperate with a coupler or quick connect coupler 142 provided adjacent to the end of a boom 116, and allow relative pivotal adjustment of the cage 51 while suspended by the boom 116 above the ground. The embodiments of the connection head 1 eliminate the need to carefully align the boom 116 lengthwise with a trench to ensure the cage 51 extends lengthwise along the trench before being lowered. Like a cage 51 suspended from the boom 116 by a chain extending between the boom 116 and the lifting eye 2, the cage 51 connected by the connection head 1A to the boom 116 can be pivoted, and optionally fully rotated in the directions of the arrow 80 in FIG. 6.

Structural steel side panels 9, 10 are joined by structural steel cross members 11 as needed to form a sufficiently strong cage to withstand the forces of a collapsing trench wall. Transparent panels 3, 7, 12 can optionally be attached via fasteners 13 to the cross members 11 or other structural supports. If present, transparent panels 3, 7 and 12 must be sufficiently strong to withstand the expected loads that can be experienced due to a collapsing trench wall. For example, the panels 3, 7, 12 can optionally be formed from safety glass, laminated glass or transparent plastic sheets such as poly (methyl methacrylate) or polycarbonate for example; Plexiglas and Lucite are illustrative examples of brand names of such panels 3, 7 and 12. According to alternate embodiments, see-though steel grating or expanded metal can be used in place of the transparent material forming the panels 3, 7, 12. The outside of each transparent panel 3, 7, 12 can optionally be provided with one or more peel-off replaceable transparent plastic lens or films 4 (FIGS. 3 and 4) to protect the panel from scratches. Such films 4 can optionally form a plurality of layers so that a film 4 can be removed occasionally as needed without being replenished.

To couple the panels 7, 12 to the cage 51, the panel 12 and/or panel 7 may be located in a set of tracks (not shown) so that the panel can be slid up or down so the worker within the cage 51 (i.e., between the side panels 9, 10) can reach outside of the cage 51 to perform work functions within the trench. Similarly, an opening can be provided in panel 3, the opening being closed via a transparent plate removeable by a worker from the inside (or slideable on tracks on the inside) the cage 51 so the worker can open it from the inside and reach out the top to work.

According to other embodiments, each steel side panel 9, 10 can optionally be provided with one or more large or small portholes 26 (FIG. 5) (covered by a plate or transparent panel removable from the inside, or slideable in a track from inside the cage 51), so the worker can open the porthole and reach out to do work.

The structural elements of the cage are preferably steel and the cage is braced and reinforced as known in the art to withstand the loads and forces found in below grade trenches. Different size cages will have different size bracing and reinforcing.

Additionally, at least one of a bracket 15, 16, rack 27, shelf 17 (FIG. 4) can each optionally be selected and attached to the cage 51 to be accessible to workers within the cage 51. For example, the any of such structures can be coupled to interior surfaces of the side panels 9, 10 or to a structural element 11 adjacent to a top of the cage 51, so as to hang a shovel (at 15), a level (at 16) etc., and to attach a portable breathing device 18 with oxygen tank in case of emergency air requirement. A shelf 17 or drawer can optionally be provided inside to hold small tools.

As shown in FIG. 4, cross members acting as braces 11 are arranged at an upward angle toward a center portion of the cage 51 in a widthwise direction so that the cage 51 can straddle a large pipe 20 (FIGS. 4 and 5), allowing workers within the cage 51 to work on and adjust the pipe 20 without significant interference from the cage 51.

A footrest 25 (see FIG. 3) for each foot of the worker can be provided inside the cage appropriately spaced from the seat, one on panel 9 and one on panel 10, so a worker seated on an optional removable seat 8 can rest his feet. The seat 8 can be coupled to one or more cross members 11 to support the worker's weight, and can optionally be permanently welded or otherwise attached, or optionally made adjustable to different heights and/or locations within the cage 51 according to alternate embodiments. Each footrest can extend inwardly, from the side panels 9, 10, and may be of the type which can fold or snap upward to get out of the way to avoid contacting a pipe or other obstruction within the trench, or it can be placed higher on the wall out of the way, or stick out from the wall only an inch or two. Other footrests known in the art can be used.

Referring again to FIGS. 3 and 4, a harness attachment 6 can also optionally be located within the cage 51 to allow workers to be tethered to the cage 51. The example of the harness attachment 6 shown in FIGS. 3 and 4 includes a rod 82 that is separated from a cross member 11, side panel 9, 10, or other structure of the cage 51 by a standoff 84. The standoff or other connection between the cage 51 and the rod 82 is suitably strong to support the weight of at least one worker without allowing the rod 82 to become detached from the structure to which it is coupled. The rod 82 can optionally extend a substantial distance long a length of the interior of the cage 51. Workers can wear a harness with a strap, rope or other suitable tether extending therefrom. A carabiner commonly used in climbing safety gear for example, or other releasable connector can be attached adjacent to an end of the tether extending from the harness. The carabiner can be clipped into the rod 82, and can be adjustable to slide along at least a portion, and optionally most or all of the length of the rod 82, including within the space separating the rod 82 from the supporting structure by the standoff 84. Thus, a worker wearing the harness connected by the carabiner to the rod 82 can walk along the length of the cage 51 and the carabiner will slide along the rod 82 with the worker. In this manner, the worker can remain tethered to the cage 51 yet travel within the cage 51 without being overly restricted.

Figure 5:
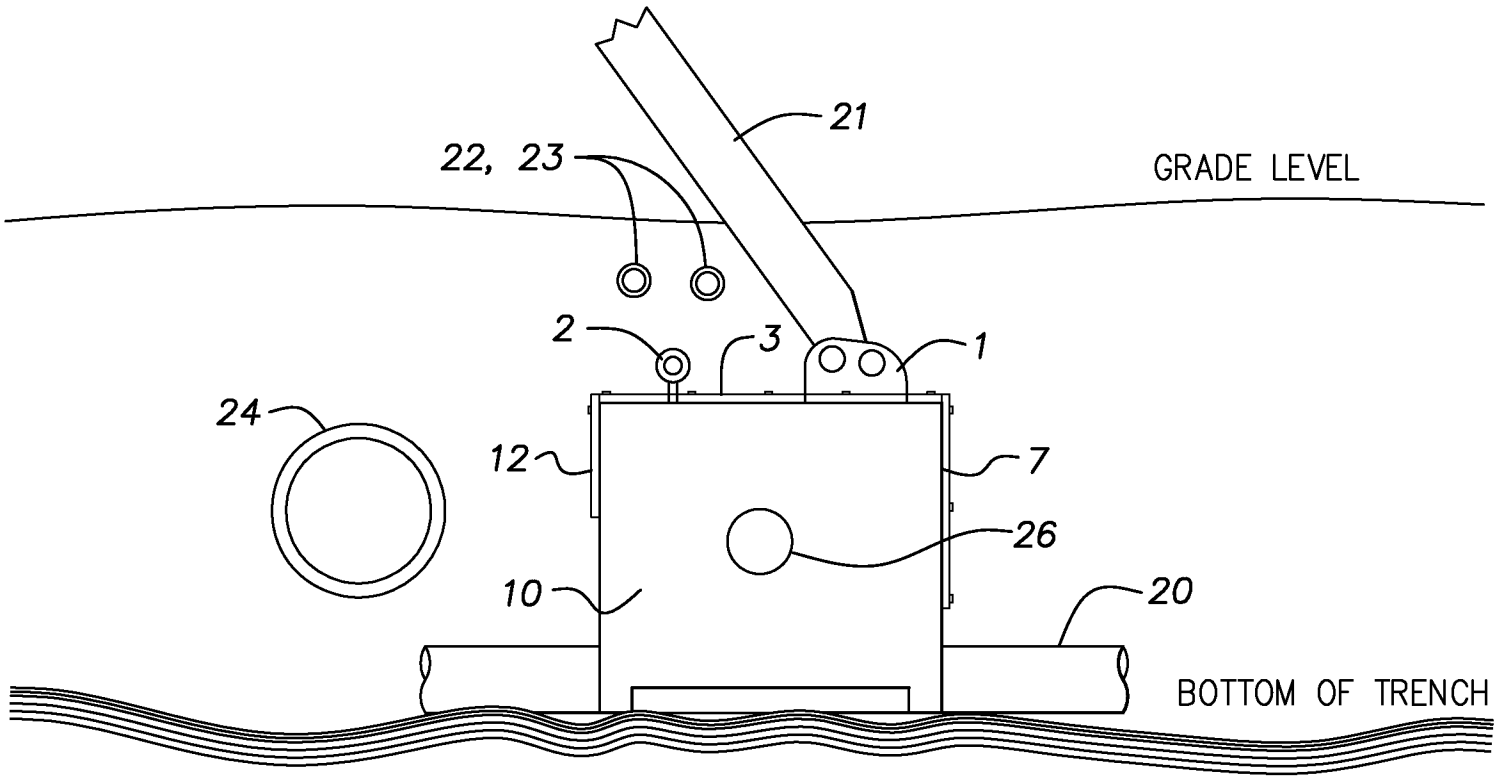
FIG. 5 shows a side view of a worker's cage in a trench straddling a pipe adjacent to a bottom of the trench.

FIG. 5 shows a side elevation of the cage 51 placed below grade in an excavation shows the cage attached to the excavator boom 116 via the coupler (not shown in FIG. 5), placing the cage 51 below existing pipes 22 and 23 giving an example of working underneath cross connection utilities. The connection between the boom 116 and the cage 51 facilitated by the connection head 1 and 1A allows accurate placement of the cage 51 in the trench without the swinging that would otherwise occur if the cage 51 was suspended by a chain from the boom 116.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cage for protecting a worker in an excavation, the cage comprising:

spaced apart side panels formed from a material suitably-strong to withstand a force exerted on the side panels by a collapsing wall of the excavation;

a plurality of cross members extending between the side panels to substantially maintain a distance separating the side panels when subjected to the force exerted by the collapsing wall of the excavation;

a harness attachment for receiving a harness connector that tethers a worker's harness to the cage, the harness attachment comprising a rod separated from a portion of the cage to which the rod is coupled to define a range of travel that the harness connector can travel along the rod; and a connection head that is cooperable with a coupler supported by a boom of a piece of mechanized equipment to couple the cage to the boom, the connection head being coupled to one or both of the side panels, one or more of the cross members, or one or both of the side panels and at least one of the cross members.

2. The cage according to claim 1 wherein the side panels are substantially parallel, and the distance separating the side panels from each other is at least one (1 ft.) foot.

3. The cage according to claim 1, wherein the first and second side wall portions define a plurality of apertures that are substantially aligned with each other; and the pin extends between the sidewalls and through the aligned apertures formed in thefirst and second side wall portions.

4. The cage according to claim 1 further comprising an optically-transparent panel that spans the distance separating the side panels that grants a worker in the cage a view of a surrounding environment.

5. The cage according to claim 4, wherein the optically-transparent panel is positioned adjacent to a longitudinal end of the cage.

6. The cage according to claim 1 further comprising a lifting eye secured to at least one of the cross members.

7. The cage according to claim 1, wherein a plurality of the cross members adjacent to a bottom portion of the side panels are angled upward toward a central region of the distance separating the side panels to avoid interfering with an object in a trench straddled by the cage.

8. The cage according to claim 1 further comprising a portable breathing device storing oxygen that is breathable by the worker within the cage.

9. The cage according to claim 1 further comprising at least one of a seat, a footrest, and a tool support.

10. A cage for protecting a worker in an excavation, the cage comprising:

spaced apart side panels formed from a material suitably-strong to withstand a force exerted on the side panels by a collapsing wall of the excavation;

a plurality of cross members extending between the side panels to substantially maintain a distance separating the side panels when subjected to the force exerted by the collapsing wall of the excavation; and a connection head that is cooperable with a coupler supported by a boom of a piece of mechanized equipment to couple the cage to the boom, the connection head being coupled to one or both of the side panels, one or more of the cross members, or one or both of the side panels and at least one of the cross members, wherein the connection head comprises a pivotal connection that pivotally couples the cage to the boom, establishing a range of travel that the cage can be pivoted relative to the coupler provided to the boom, the pivotal connection comprising:

a bracket defining an aperture, a plurality of side walls extending upwardly from the bracket and supporting a connector that is compatible with the coupler provided to the boom, and a metallic member that extends through the aperture in the bracket and comprises:

adjacent to a first end vertically above the aperture, a flanged portion having a dimension that is larger than a dimension of the aperture, and a connection portion adjacent to a second end of the metallic member vertically below the aperture coupled to the cage, wherein the metallic member is pivotal relative to the bracket to allow pivoting of the cage relative to the coupler provided to the boom.

* * * * *